United States Patent [19]

Suzuki

[11] Patent Number: 4,905,048

[45] Date of Patent: Feb. 27, 1990

[54] COLOR COPYING APPARATUS

[75] Inventor: Minoru Suzuki, Yokohama, Japan

[73] Assignee: Ricoh Company, Ltd., Tokyo, Japan

[21] Appl. No.: 305,636

[22] Filed: Feb. 3, 1989

[30] Foreign Application Priority Data

Feb. 5, 1988 [JP] Japan ..... 63-23962
Dec. 27, 1988 [JP] Japan ..... 63-327960

[51] Int. Cl.[4] ..... G03G 15/16

[52] U.S. Cl. ..... 355/271; 355/277; 355/281

[58] Field of Search ..... 355/271, 277, 281

[56] References Cited

U.S. PATENT DOCUMENTS

| | | | |
|---|---|---|---|
| 4,025,182 | 4/1976 | Goel | 355/271 |
| 4,588,279 | 5/1986 | Fukuchi et al. | 355/271 |
| 4,664,501 | 5/1987 | Koizumi et al. | 355/327 |
| 4,690,542 | 9/1987 | Furuta et al. | 355/327 |
| 4,745,435 | 5/1988 | Sakata et al. | 355/271 |
| 4,746,950 | 5/1988 | Mamizuka et al. | 355/270 |
| 4,750,018 | 6/1988 | Gooray et al. | 355/271 X |
| 4,751,549 | 6/1988 | Koizumi | 355/271 X |

FOREIGN PATENT DOCUMENTS 58-198062 11/1983 Japan .

*Primary Examiner*—A. C. Prescott

*Attorney, Agent, or Firm*—Oblon, Spivak, McClelland, Maier & Neustadt

[57] ABSTRACT

A color copying apparatus which comprises: a latent image forming device for forming a latent image of a figure to be printed; an image forming medium on which the latent image is formed; a plurality of development devices for developing the latent image formed on the image forming medium by a different color toner, respectively; and an endless conveyor belt spanning between two rollers and for carrying a transfer material to which the developed colored toner image is transferred from the image forming medium. The copying apparatus is featured to comprise a first shifting system for shifting a whole of the conveyor belt close to and away from the image forming medium and a second shifting system for shifting a part of the conveyor belt close to and away from the image forming medium at a position where the toner image is transferred from the image forming medium to the transfer material. In accordance with the featured structure of the present invention, it becomes possible to slightly shift the conveyor belt away from the image forming medium in the copying operation, while in the maintenance operation it is possible to shift the conveyor belt sufficiently away from the image forming medium for facilitating the maintenance operation.

16 Claims, 5 Drawing Sheets

COLOR COPYING APPARATUS

BACKGROUND OF THE INVENTION

The present invention relates to a color copying apparatus which forms a color image on a transfer material which reciprocates with respect to a photoconductor on which a color toner image to be transferred is formed.

The above mentioned kind of color copying apparatus comprises an endless conveyor belt for conveying the transfer material which conveyor is driven to move forward and backward repeatedly. An image of one color is transferred on a transfer material, i.e. on a copy paper during a forward movement of the conveyor belt. Then the belt is moved backward and again moves forward so that the image of a second color is transferred during this subsequent forward movement. With such an arrangement of the color copying apparatus, the conveyor belt comes in contact with the photoconductor in the forward movement of the conveyor to transfer the color toner image from the photoconductor to the copy paper, whereas the conveyor belt must be shifted away from the photoconductor surface in the backward movement of the conveyor belt in order to avoid damaging the unfixed toner image formed on the copy paper being conveyed by the belt by contacting with and rubbed by the photoconductor surface. In this case, the required length of the gap between the photoconductor surface and the conveyor belt is very small, since even a very small length of the gap is enough for avoiding the contact therebetween.

On the other hand, if the gap is small, it is inconvenient at the time of maintenance of the apparatus such as changing the photoconductor or repairing jamming of the paper. Therefore, a large gap between the photoconductor and the conveyor belt is required from the standpoint of the maintenance operation.

There has not been developed so far a color copying apparatus which comprises a means for shifting the conveyor belt which means satisfies the above mentioned two contradictory requirements.

SUMMARY OF THE INVENTION

It is therefore an object of the present invention to provide a color copying apparatus which comprises a means for shifting the conveyor belt which means makes it possible to move the conveyor belt away from the photoconductor surface by a small length of displacement in the backward movement during the reciprocation cycle thereof for the copying operation as well as to move the conveyor belt away from the photoconductor by a large length of displacement at the time of maintenance of the apparatus, thus enabling to reduce the power required for shifting the conveyor belt and increase the copying speed as well as to easily carry out the maintenance operation.

The object of the invention can be achieved by a color copying apparatus comprising: a photoconductor on which color toner images of different colors are formed one after another; a transfer material to which each of the color toner images is transferred every time after the image is formed; a conveyor belt which carries the transfer material thereon and moves the same forward and backward; a first shifting means for moving a whole of the entire conveyor belt toward and away from the photoconductor; and a second shifting means for moving a part of the conveyor belt surface.

The advantages of the above mentioned color copying apparatus are as follows. The color copying apparatus in accordance with the present invention forms a multicolor toner image on a copy paper by superposing different color toner images by a reciprocation movement of the conveyor belt in a copying operation cycle thereof. The color copying apparatus of the present invention functions in such a way that the conveyor belt very slightly shifts away from the photoconductor each time when the belt is driven to move backward in the reciprocation movement thereof so that unnecessary excessive movement for shifting the conveyor belt is removed, which makes it possible to shift the conveyor belt with a small power and achieve a high speed copying operation. Also, it is possible to enlarge the displacement of the conveyor belt at the time of maintenance of the copying apparatus or repairing the jam of the paper, which facilitates the maintenance or repairing operation.

Besides, it is possible to disengage the conveyor belt from the drive means at the time of maintenance or repairing operation so that the conveyor belt can be freely rotated to further facilitate the maintenance or repairing operation.

Further objects and advantages of the present invention will be apparent from the following description of the preferred embodiments of the invention as illustrated in the accompanying drawings.

DESCRIPTION OF THE PREFERRED EMBODIMENTS

Preferred embodiments of the present invention are described hereinafter with reference to the accompanying drawings.

Figure 1:
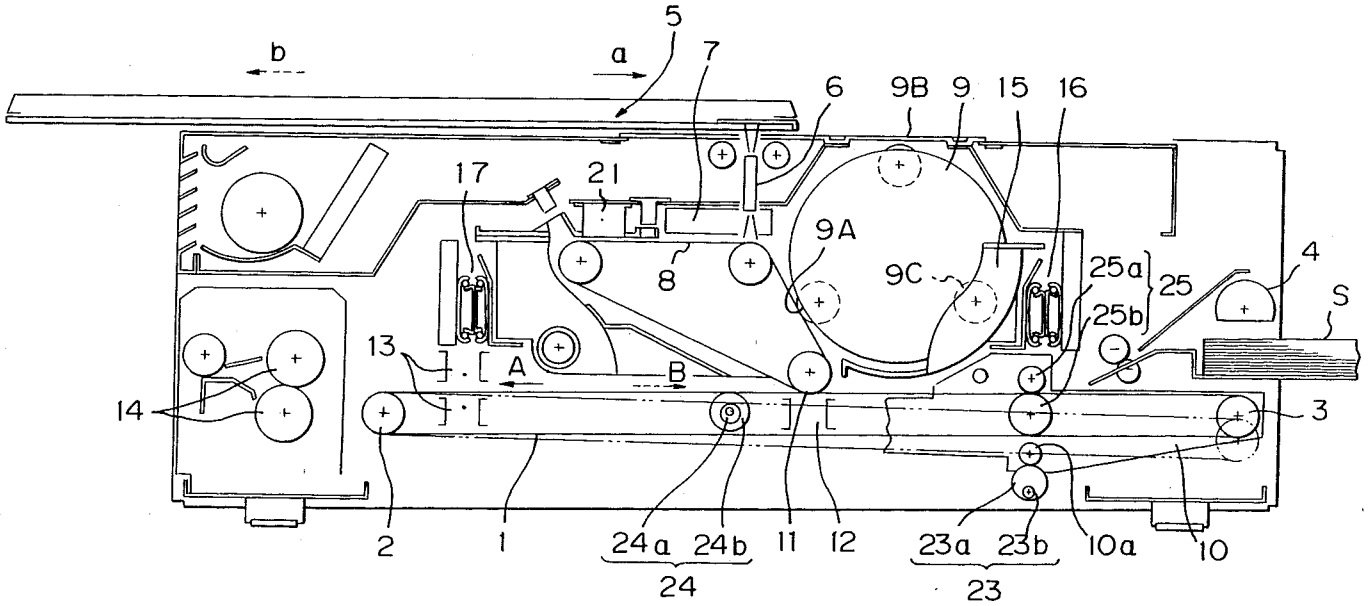
FIG. 1 is a constructional view of a first embodiment of the color copying apparatus in accordance with the present invention.

FIG. 1 illustrates a whole structure of an embodiment of a color copying apparatus in accordance with the present invention. An original stage 5 for placing thereon a colored original (not shown) to be copied is disposed on an upper side of an apparatus body. The original stage 5 is driven to reciprocatedly move rightward and leftward on the apparatus body. During the rightward movement of the original stage 5 shown by an arrow a, the colored original figure is projected and imaged on a photoconductor belt 8 through a converging optical transmission array 6 and an optical filter 7 so as to form electrostatic latent images on the photoconductor belt 8. The original color is analyzed to a plurality of different color elements. The original is projected and imaged on the photoconductor belt with regard to each of the analyzed color elements so that electrostatic latent images corresponding to the analyzed different colors are formed on the photoconductor belt. The electrostatic latent images are developed by a development device 9 comprising three developer sleeves 9A, 9B and 9C each of which comprises a toner of different color and develops a corresponding electrostatic latent image with the color toner thereof after being moved to a developing position facing to the photoconductor belt 8 one after another.

The developed toner images of a different color formed on the photoconductor belt 8 are transferred to a copy paper S one after another. For this purpose, an endless conveyor belt 1 is arranged spanning between a drive roller 2 and a follower roller 3. The copy paper S is supplied from a stacker onto the conveyor belt 1 by a feed roller 4.

The copy paper S is conveyed toward the photoconductor belt 8 by the conveyor belt 1 moving in a direction of an arrow A. During the copy paper S is passing through a transferring position 11, a first developed toner image of one color is transferred onto the copy paper S by a transfer charger 12.

While the conveyor belt 1 is moved in the direction of the arrow A to transfer the toner image to the copy paper, the original stage 5 is moved in the direction of an arrow a which direction is opposite to that of the movement of the conveyor belt in the transferring operation. When a rear end of the copy paper S passes the transferring position 11, the first transferring operation is finished. The conveyor belt 1 is moved backward in the direction of an arrow B to the contrary to the forward direction of the arrow A for preparing a second transferring operation. Also, simultaneously with this backward motion of the conveyor belt, the original stage 5 is moved backward in the direction of an arrow b. A resist roller means 25 comprising a pair of resist rollers **25*a* and 25*b* is disposed holding the conveyor belt 1 between the rollers 25*a* and 25*b* in the vicinity of the feed roller 4 to prevent a double feeding of the paper wherein superposed two papers sticking together are simultaneously supplied. When one copy paper S is fed through the resist roller means 25 to the transferring position 11, the upper resist roller 25*a* is forced to move upward to be discontacted from the conveyor belt 1 by a cam means (not shown) so as to prevent the unfixed toner image formed on the copy paper from being rubbed and stained. This state of discontact of the upper resist roller 25*a* from the conveyor belt is maintained until the copying operation cycle for one copy paper is finished. When one copying operation cycle is finished, the upper resist roller 25*a*** is restored to the initial state of contacting to the conveyor belt to prevent the double feeding of the copy paper in the subsequent paper feeding operation.

The conveyor belt 1 comprises a dielectric strip film formed as an endless belt which is arranged to be wound around and spanning between the drive roller 2 and the follower roller 3, both rollers 2 and 3 being mounted on a support frame 10.

In accordance with a featured structure of the present invention, the copying apparatus comprises a first shifting means for moving the support frame 10 of the conveyor belt 1 between a contact position in which the conveyor belt 1 comes in contact with the photoconductor belt 8 during the copying operation and a discontact position in which the conveyor belt 1 is separated away from the photoconductor belt 8 during the maintenance or jam repairing operation.

In accordance with the first embodiment of the present invention illustrated in FIG. 1, the support frame 10 is constructed in such a way that the support frame is rotatable about an axis of the drive roller 2 which supports an end of the conveyor belt 1 so that the follower roller side of the frame is rotatably movable.

In order to move the follower roller side of the support frame, the support frame 10 has an abutment **10*a* which is carried on an eccentric roller 23*a* of a changing member 23 which is mounted on the apparatus body. The changing member 23 comprises the eccentric roller 23*a* installed on a rotary shaft 23*b*. By rotating the eccentric roller 23*a*, it is possible to shift the support frame 10 from the upper contact position illustrated in solid lines in FIG. 1 to the lower discontact position illustrated in dash-two-dot lines. In the copying operation, the support frame 10 is shifted to the upper position in which the conveyor belt 1 comes in contact with the photoconductor belt 8 enabling to transfer the toner image from the photoconductor belt surface to the copy paper carried on the conveyor belt 1. On the other hand, in the maintenance operation, the eccentric roller 23*a* of the changing member 23 is rotated to reverse the upside down so that the support frame 10 is shifted to the lower position in which the conveyor belt 1 is separated away from the photoconductor belt 8 to make a space of a predetermined gap between the conveyor belt 1 and the photoconductor belt 8**.

A second embodiment of the present invention is illustrated in FIGS. **3*a* and 3*b* which show another example of the first shifting means for changing the position of the support frame 10 for carrying the conveyor belt 1** thereon.

In accordance with this example, the support frame 10 is rotated about a pivot axis **10*b* which is disposed at an outer end of the support frame 10 in the outside of the drive roller 2**.

The drive roller 2 is driven by a drive system (not shown) mounted on the apparatus body side so as to move the conveyor belt 1 in the direction of the arrow A or B. In the embodiment of FIGS. **3*a* and 3*b*, a drive gear 18 of the drive system mounted on the apparatus body side engages with a transmission gear 2*a* which is arranged coaxial with the drive roller 2**.

Figure 3A:
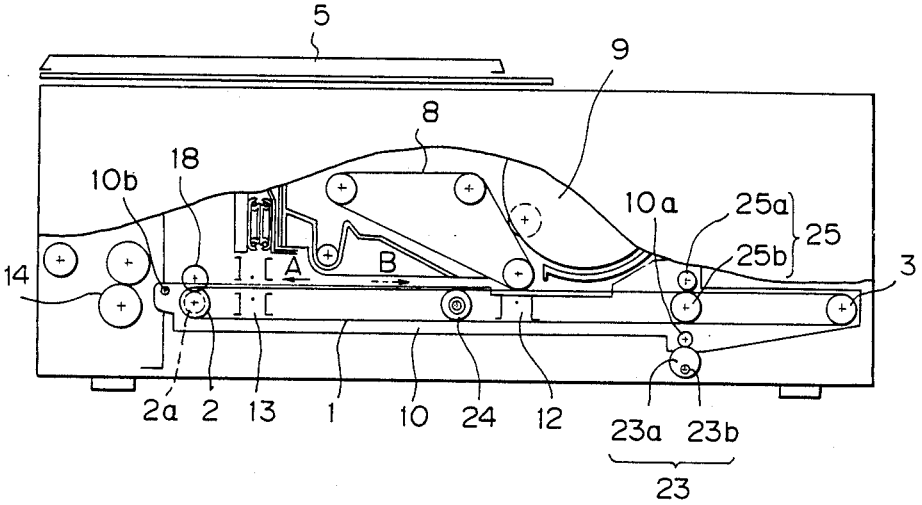
FIGS. 3*a* and 3*b* are constructional views of a second embodiment of the color copying apparatus in accordance with the present invention.
Figure 4A:
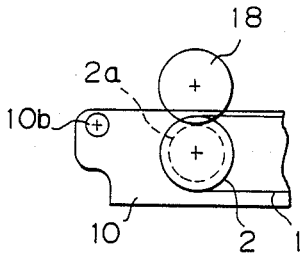
FIGS. 4*a* and 4*b* are explanatory views for explaining the function of the second embodiment of the invention.
Figure 4B:
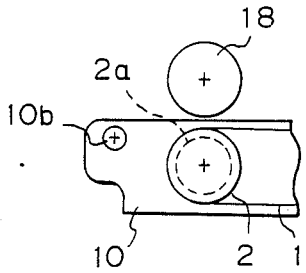

This second embodiment also comprises the changing member 23 in the follower roller side of the support frame 10 arranged in the same manner as in the first embodiment of FIG. 1. Due to the function of this changing member 23, the support frame 10 is rotated about the pivot axis **10*b* so that when in the copying operation, the support frame 10 is shifted to the upper position, as shown in FIG. 3*a*, in which the conveyor belt 1 comes in contact with the photoconductor belt 8. Also, in this state of the copying operation, the transmission gear 2*a* arranged coaxial with the drive roller 2 engages with the drive gear 18 of the drive system, as illustrated in an enlarged scale in FIG. 4*a*, so that the drive force can be transmitted from the drive system to the conveyor belt 1 through the gears 18 and 2*a* and the drive roller 2**.

On the other hand, when in the jam repairing or maintenance operation, the support frame 10 is shifted to the lower position, as illustrated in FIG. **3*b*, so that the upper surface of the conveyor belt 1 is separated away from the photoconductor belt 8 to form a gap of predetermined amount between the conveyor belt and the photoconductor belt. Also, in this state of the maintenance operation, the transmission gear 2a arranged coaxial with the drive roller 2 is disconnected from the drive gear 18 of the drive system so that the conveyor belt 1** becomes freely rotatable, which facilitates the maintenance or jam repairing operation in the state of the conveyor belt being separated away from the photoconductor belt to form a space therebetween.

Figure 5A:
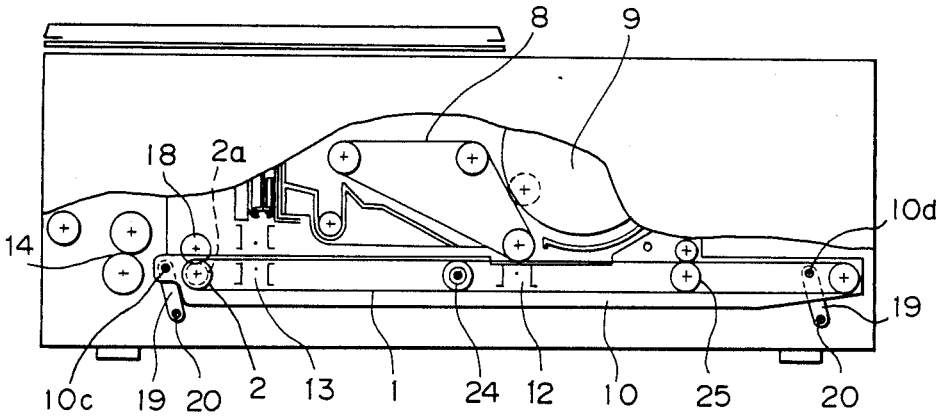
FIGS. 5*a* and 5*b* are constructional views of a third embodiment of the color copying apparatus in accordance with the present invention.
Figure 5B:
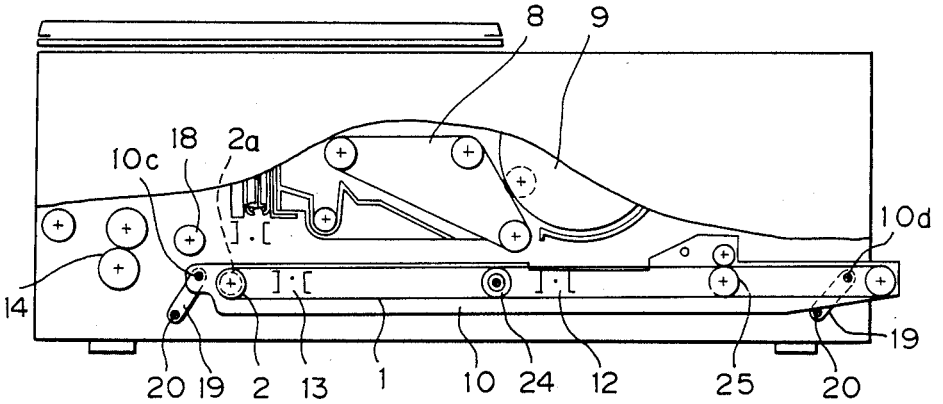

A third embodiment of the present invention is illustrated in FIGS. 5a and 5b which show a further example of the first shifting means for shifting the support frame 10.

In accordance with this embodiment, the shifting means comprises a pair of levers 19 each of which is rotatably connected to each end of the support frame 10 to carry the support frame and change the position thereof. Each of the levers 19 is constructed in such a way that a lower end of the lever is rotatably connected to a shaft 20 secured to the apparatus frame so that the lever 19 is movable from an upright position illustrated in FIG. 5a to an inclined position inclined in the clockwise direction as illustrated in FIG. 5b and vice versa. The upper end of the lever 19 is rotatably connected to each of the ends 10c and 10d of the support frame 10. Also, the drive system of the conveyor belt is constructed in such a way that when the lever is in the upright position, the transmission gear 2a arranged coaxial with the drive roller 2 engages with the drive gear 18 of the drive system, whereas when the lever is in the inclined position, the transmission gear 2a disengages from the drive gear 18.

When the lever 19 is positioned at the upright position, as shown in FIG. 5a, the conveyor belt 1 mounted on the support frame 10 comes in contact with the photoconductor belt 8 so that the copying operation can be carried out. Also, in this state of the upper position of the conveyor belt 1 (upright position of the lever 19), the transmission gear 2a of the drive roller 2 mounted on the support frame 10 is connected to the drive gear 18 of the drive system secured to the apparatus frame.

Figure 6A:
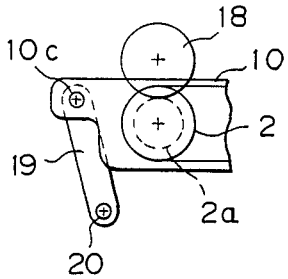
FIGS. 6*a* and 6*b* are explanatory views for explaining the function of the third embodiment of the invention.
Figure 6B:
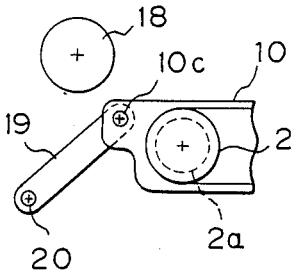

On the other hand, when the lever 19 is moved to the inclined position, as illustrated in FIG. 5b, the support frame 10 is shifted downward in the rightward direction so that the conveyor belt 1 is separated away from the photoconductor belt 8 forming a space between the conveyor belt and the photoconductor belt. Also, in this state of the lower position of the conveyor belt 1 (inclined position of the lever 19), the transmission gear 2a of the drive roller 2 mounted on the support frame 10 is disconnected from the drive gear 18 of the drive system secured to the apparatus frame, as illustrated in FIG. 6b. Therefore, the conveyor belt 1 can be freely rotated, being released from the drive system, so that the maintenance or jam repairing operation can be easily carried out.

Within the inside area of the conveyor belt 1 mounted on the support frame 10 are disposed the lower resist roller 25b, the transfer charger 12, the back up roller unit 24 described later in detail, and a part of a static eliminator 13.

Figure 2A:
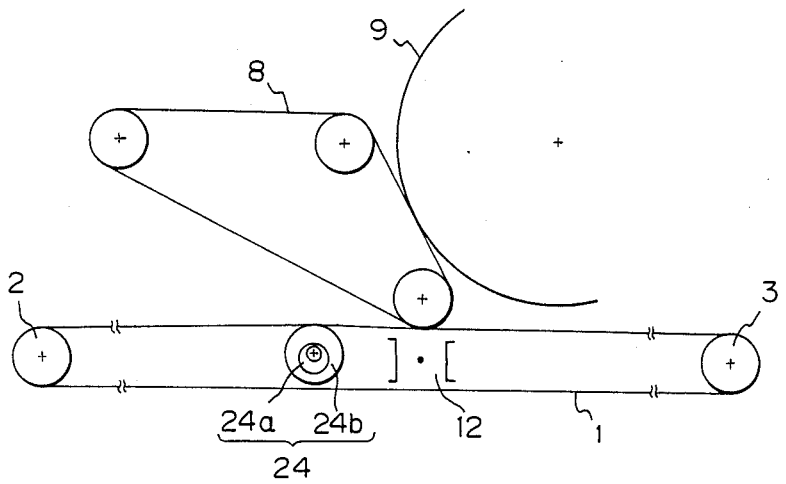
FIGS. 2*a* and 2*b* are explanatory views for explaining the function of a back up roller to shift the conveyor belt of the copying apparatus of FIG. 1.
Figure 2B:
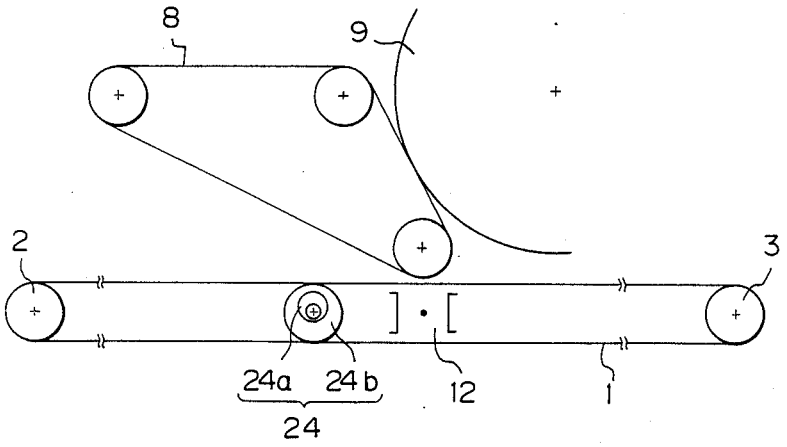

A featured structure of the second shifting means in accordance with the present invention is described below with reference to FIG. 1 and FIGS. 2a and 2b. The second shifting means for slightly displacing the conveyor belt in the copying operation comprises in this particular embodiment a back up roller unit 24.

The back up roller unit 24 is disposed near the transferring position where the conveyor belt and the photoconductor belt substantially come in contact with each other and comprises a rotary shaft 24a and an eccentric roller 24b secured to the rotary shaft 24a in such a way that the eccentric roller 24b is able to come in contact with the conveyor belt 1 from the inside thereof. By rotating the rotary shaft 24a, the eccentric roller 24b rotates between a first position where the upper surface of the conveyor belt 1 comes in contact with the photoconductor belt 8, as illustrated in FIG. 2a, and a second position where the upper surface of the conveyor belt 1 is disengaged from the photoconductor belt 8, as illustrated in FIG. 2b.

The displacement of the conveyor belt 1 by the back up roller 24 in the copying operation corresponds to the length from the position where the conveyor belt comes in contact with the photoconductor belt in the forward motion of the conveyor belt to the position where the conveyor belt is disengaged from the photoconductor belt in the backward motion of the conveyor belt so as to prevent the unfixed toner image formed on the copy paper from being rubbed by the photoconductor surface. Length of about 0.5 to 5 mm is usually preset as the displacement of the conveyor belt. Referring back to FIG. 1, numeral 14 designates fixing rollers, numeral 15 designates an image forming housing in which the photoconductor belt 8 and the development device 9 are installed, numerals 16 and 17 designate a guide rail for drawing out the image forming housing 15 and numeral 21 designates an electrostatic charger.

The color copying apparatus having the above mentioned structure in accordance with the present invention functions as follows. In the copying operation, first, the photoconductor belt is irradiated, for example, by a blue light and a color toner image is developed thereon by a yellow developer sleeve 9A. The color toner image is transferred at the transferring position 11 by the transfer charger 12 to the copy paper S which is being conveyed in the forward direction of the arrow A by the conveyor belt 1. During this transferring operation, the back up roller unit 24 urges the conveyor belt 1 to come in contact with the photoconductor belt 8. When the rear end of the copy paper S passes the transferring position 11, the conveyor belt 1 is driven to move backward. Also, along with this backward motion of the conveyor belt, the rotary shaft 24a of the back up roller unit 24 is driven to rotate so that the eccentric roller 24b is rotated and changed the rotational position thereof to the position in which the conveyor belt 1 is shifted away from the photoconductor belt 8 by a slight displacement to form a small gap between the conveyor belt 1 and the photoconductor belt 8. With such an arrangement, the toner image transferred to the copy paper S is avoided from being rubbed by the photoconductor belt surface in the backward motion of the conveyor belt 1 in the direction of the arrow B. The copy paper S is conveyed back to the right side of the transferring position 11 for preparing the subsequent transferring operation to transfer the another toner image of another color. Also, in this backward motion of the copy paper, the upper resist roller 25a is shifted upward to the position away from the conveyor belt 1 so that the copy paper S does not come in contact with the upper resist roller 25a, thus avoiding the toner image transferred on the copy paper from being rubbed and stained by the resist roller 25a.

After that, the photoconductor belt is irradiated by a green light and a toner image is developed by a magenta developer sleeve 9B. Subsequently, the photoconductor belt is irradiated by a red light and a toner image is developed by a cyanic developer sleeve 9C. These toner images of different color are transferred one after another to the copy paper in each forward motion of the conveyor belt so that the color toner images are superposed one above the other without misalignment on one copy paper, thereby forming a multicolored toner image on the copy paper.

When the transferring cycles by the reciprocation movement of the conveyor belt for all of the color toner images are finished, the copy paper S is conveyed to the fixing device 14 through the electrostatic eliminator 13 to fix the multicolored toner image on the copy paper. After that, the copy paper is discharged from the copying apparatus.

In the above mentioned copying operation, the back up roller unit 24 is linked to cooperate with the conveyor belt in such a way that the eccentric roller 24*a* is automatically rotated when the conveying direction of the conveyor belt is changed so that the conveyor belt comes in contact with the photoconductor belt in the forward motion thereof while being shifted away from the photoconductor belt in the backward motion of the conveyor belt.

Figure 3B:
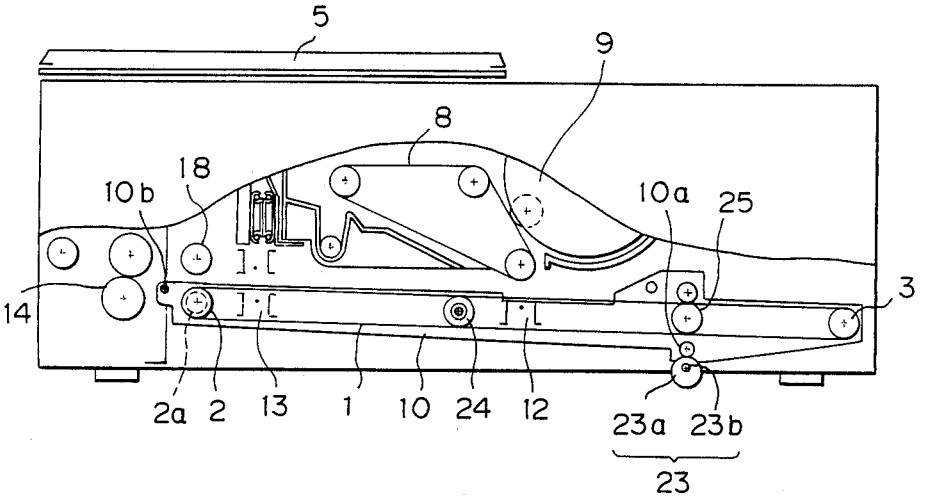

On the other hand, when in the jam repairing or maintenance operation, the eccentric roller 23*a* is rotated to change the rotational position thereof by rotating the rotary shaft 23*b* of the changing member 23 which carries the abutment 10*a* thereon which abutment is secured to the lower portion of the movable side of the support frame 10. With this arrangement, the support frame 10 is rotated in the clockwise direction about the axis of the drive roller 2 from the position illustrated in solid lines in FIG. 1 for copying operation to the position in which the whole of the conveyor belt is inclined and shifted downward away from the photoconductor belt as illustrated by dash-two-dot lines in FIG. 1. Also, in accordance with the embodiment of FIGS. 3*a* and 3*b*, the support frame 10 is rotated about the pivot shaft 10*b* arranged at the end portion of the support frame so that the whole of the conveyor belt is rotated and shifted downward away from the photoconductor belt to form a space above the conveyor belt for facilitating the maintenance operation. Further, in accordance with the embodiment of FIGS. 5*a* and 5*b*, the levers 19 for supporting and changing the position of the support frame 10 are rotated from the upright state to the inclined state so that the support frame 10 on which the conveyor belt 1 is mounted is shifted downward away from the photoconductor belt 8. In these shifting motions to separate the conveyor belt from the photoconductor belt by moving the whole structure of the conveyor belt for the maintenance operation, the rotational force transmission gear 2*a* of the drive roller 2 for the conveyor belt is disconnected from the drive gear 18 of the drive system mounted on the apparatus frame side so that the conveyor belt can be freely rotated, which facilitates to remove a jammed paper in the jam repairing operation. It is possible to arrange the support frame 10 in such a way that the support frame is automatically shifted to the position separated from the photoconductor belt by a jam signal.

Note that the present invention can be widely applied to various printers other than the copying apparatus such as a laser printer, a pin electrode printer and a terminal printer of a facsimile device.

Many widely different embodiments of the present invention may be constructed without departing from the spirit and scope of the present invention. It should be understood that the present invention is not limited to the specific embodiments described in the specification, except as defined in the appended claims.

What is claimed is:

1. A color copying apparatus comprising:

a latent image forming means for forming a latent image of a figure to be printed;

an image forming medium on which the latent image is formed;

a plurality of development means for developing the latent image formed on the image forming medium by a different color toner, respectively;

an endless conveyor belt spanning between two rollers and for carrying a transfer material to which the developed colored toner image is transferred from the image forming medium;

a first shifting means for shifting a support frame of the conveyor belt close to and away from the image forming medium; and a second shifting means for shifting a part of the conveyor belt close to and away from the image forming medium at a position where the toner image is transferred from the image forming medium to the transfer material.

2. A color copying apparatus according to claim 1, wherein the latent image forming means comprises an exposure device using a scanning light reflected from the original to be copied.

3. A color copying apparatus according to claim 1, wherein the image forming medium comprises a photoconductor on which an electrostatic latent image can be formed.

4. A color copying apparatus according to claim 1, wherein the plurality of the development means are mounted on a rotary support member in such a way that each development means can be moved to a position facing to the image forming medium.

5. A color copying apparatus according to claim 1, wherein the transfer material comprises a print paper.

6. A color copying apparatus according to claim 1, wherein the conveyor belt is reciprocatedly movable and driven in such a way that a toner image is transferred to the transfer material carried thereon in a forward motion thereof and that the conveyor belt moves backward to move the transfer material to a position before a transferring portion of the toner image and after that a toner image of another color is transferred to the transfer material in a subsequent forward motion thereof.

7. A color copying apparatus according to claim 1, wherein the first shifting means comprises a rotary shifting mechanism having a rotational center near an end of the conveyor belt.

8. A color copying apparatus according to claim 7, wherein the rotational center coincides with an axis of one of the rollers which support the conveyor belt at the ends thereof.

9. A color copying apparatus according to claim 7, wherein the rotational center is disposed on a support frame on which the conveyor belt is mounted.

10. A color copying apparatus according to claim 1, wherein the first shifting means comprises a cam mechanism comprising a cam disposed on an apparatus frame side and a cam follower secured to a support frame of the conveyor belt.

11. A color copying apparatus according to claim 1, wherein a drive system of the conveyor belt is arranged in such a way that the drive system comprises a rotational force transmission gear which is coaxial with one of the rollers supporting the conveyor belt and a drive gear which engages with the rotational force transmission gear to transmit thereto a rotational force from a motor means mounted on an apparatus frame and that when the conveyor belt is shifted to a position separated from the image forming medium by the first shifting means, the rotational force transmission gear is disengaged from the drive gear.

12. A color copying apparatus according to claim 1, wherein the second shifting means comprises a cam mechanism which abuts against an inside surface of the conveyor belt to move the conveyor belt toward and away from the image forming medium.

13. A color copying apparatus comprising:

a latent image forming means for forming a latent image of a figure to be printed;

an image forming medium on which the latent image is formed;

a plurality of development means for developing the latent image formed on the image forming medium by a different color toner, respectively;

an endless conveyor belt spanning between two rollers and for carrying a transfer material to which the developed colored toner image is transferred from the image forming medium;

a first shifting means for shifting a support frame of the conveyor belt close to and away from the image forming medium; and a second shifting means for shifting a part of the conveyor belt close to and away from the image forming medium at a position where the toner image is transferred from the image forming medium to the transfer material, wherein the first shifting means comprises a rotational lever disposed at each end of a conveyor belt support frame, an end of the lever being rotatably connected to the support frame side and the other end thereof being rotatably connected to an apparatus frame side.

14. A color copying apparatus according to claim 13, wherein a drive system of the conveyor belt is arranged in such a way that the drive system comprises a rotational force transmission gear which is coaxial with one of the rollers supporting the conveyor belt and a drive gear which engages with the rotational force transmission gear to transmit thereto a rotational force from a motor means mounted on an apparatus frame and that when the conveyor belt is shifted to a position separated from the image forming medium by the first shifting means, the rotational force transmission gear is disengaged from the drive gear.

15. A color copying apparatus comprising:

a latent image forming means for forming a latent image of a figure to be printed;

an image forming medium on which the latent image is formed;

a plurality of development means for developing the latent image formed on the image forming medium by a different color toner, respectively;

an endless conveyor belt spanning between two rollers and for carrying a transfer material to which the developed colored toner image is transferred from the image forming medium;

a shifting means for shifting a support frame of the conveyor belt close to and away from the image forming medium;

wherein the shifting means comprises a rotational lever disposed at each end of a conveyor belt support frame, an end of the lever being rotatably connected to the support frame side and the other end thereof being rotatably connected to an apparatus frame side.

16. A color copying apparatus according to claim 15, wherein a drive system of the conveyor belt is arranged in such a way that the drive system comprises a rotational force transmission gear which is coaxial with one of the rollers supporting the conveyor belt and a drive gear which engages with the rotational force transmission gear to transmit thereto a rotational force from a motor means mounted on an apparatus frame and that when the conveyor belt is shifted to a position separated from the image forming medium by the shifting means, the rotational force transmission gear is disengaged from the drive gear.

* * * * *